US007709756B2

(12) United States Patent
Poyner et al.

(10) Patent No.: US 7,709,756 B2
(45) Date of Patent: May 4, 2010

(54) SAFETY SWITCH

(75) Inventors: Julian Poyner, Hazel Grove (GB); Burt Sacherski, Nashua, NH (US)

(73) Assignee: Rockwell Automation Limited, Milton Keynes (GB)

( * ) Notice: Subject to any disclaimer, the term of this patent is extended or adjusted under 35 U.S.C. 154(b) by 0 days.

(21) Appl. No.: 11/536,453

(22) Filed: Sep. 28, 2006

(65) Prior Publication Data

US 2007/0074962 A1 Apr. 5, 2007

(30) Foreign Application Priority Data

Sep. 30, 2005 (GB) ..... 0519929.4

(51) Int. Cl.
*H01H 27/00* (2006.01)

(52) U.S. Cl. ..... 200/43.04; 200/43.05

(58) Field of Classification Search ..... 200/43.04
See application file for complete search history.

(56) References Cited

U.S. PATENT DOCUMENTS

| | | | | |
|---|---|---|---|---|
| 3,735,064 | A | 5/1973 | Hoober et al. | |
| 4,118,607 | A | 10/1978 | Shaffer | |
| 4,405,844 | A | 9/1983 | Dizon et al. | |
| 5,420,385 | A | 5/1995 | Cooper | |
| 5,423,198 | A | 6/1995 | DiVito et al. | |
| 5,540,069 | A | 7/1996 | Muller et al. | |
| 5,543,665 | A | 8/1996 | Demarco | |
| 5,622,253 | A | 4/1997 | Wecke et al. | |
| 6,130,387 | A * | 10/2000 | Bricaud et al. | 200/43.04 |
| 6,307,167 | B1 * | 10/2001 | Kajio et al. | 200/43.11 |
| 6,720,508 | B2 * | 4/2004 | Moriyama et al. | 200/200 |
| 6,734,379 | B1 | 5/2004 | Savadian et al. | |
| 6,960,991 | B2 | 11/2005 | Orcifalvi et al. | |
| 7,138,589 | B2 * | 11/2006 | Tanaka et al. | 200/43.04 |
| 2005/0199478 | A1 * | 9/2005 | Jones | 200/43.04 |
| 2006/0090992 | A1 * | 5/2006 | Takenaka et al. | 200/334 |

FOREIGN PATENT DOCUMENTS

| | | | |
|---|---|---|---|
| EP | 0704353 | A1 | 4/1996 |
| FR | 2 570 468 | | 9/1984 |
| GB | 2190700 | A * | 11/1987 |
| GB | 2356426 | A | 5/2001 |

OTHER PUBLICATIONS

Translation of FR 2 570 468.
European Search Report.

* cited by examiner

*Primary Examiner*—Michael A Friedhofer
*Assistant Examiner*—Lheiren Mae A Anglo
(74) *Attorney, Agent, or Firm*—Boyle Fredrickson LLP; William R. Walbrun; John M. Miller

(57) ABSTRACT

A safety switch assembly includes a body constructed to be mounted in a support structure and generally enclose the operative structure of the safety switch. The safety switch assembly includes an actuator constructed to pass through one of the support structure or the base to operatively engage the operative structure of the safety switch to control the safety switches electrical orientation to communicate or terminate communication of electrical power to a device equipped with the safety switch.

8 Claims, 7 Drawing Sheets

SAFETY SWITCH

CROSS REFERENCE TO RELATED APPLICATION

This application claims priority under 35 U.S.C. §119 to United Kingdom Patent Application No. 0519929.4 filed Sep. 30, 2005, entitled "Safety Switch" and the entirety of which is incorporated herein by reference.

BACKGROUND OF THE INVENTION

The present invention relates to safety switches, and to safety switch assemblies.

A safety switch may be considered as an emergency electrical shut off switch, and either allows or prevents electricity from passing through it (i.e. it provides a closed circuit or an open circuit). If the safety switch is activated, such that it forms an open circuit, electricity will not pass to any device to which the safety switch is connected.

Safety switches are often used in places where access to particular enclosures is to be restricted, such enclosures enclosing electrically operated machinery. For example, safety switches are often found in factories that use kinetic machinery powered by electricity. The safety switch may be used to prevent access to an enclosure containing the machinery when the machinery is in operation. Specifically, power will only be supplied to the machinery when the switch is closed, and this is conveniently achieved by the closure of a gate incorporated in the enclosure. When the gate is opened, the safety switch is activated, the circuit is broken, and the electrical power supply to the machinery is interrupted (i.e. the machinery cannot run when the gate is opened and the safety switch is thereby activated). Safety switches are well known in the art, and come in a variety of different forms.

A safety switch will usually comprise a switch mechanism which is housed in a housing and attached to part of a structure forming the enclosure. A protruding actuator (i.e. a key) may be attached to a gate which is movable relative to the enclosure and the safety switch mechanism. When the gate is closed, the actuator engages with the switch mechanism to allow supply of electrical power to the machinery.

While safety switches are intended to be beneficial to workers using and moving around dangerous machinery within a factory, it is not uncommon for the switches themselves to be tampered with. For example, it may be that workers wish to inspect dangerous machinery while it is in operation. In order to do this, they may take off the cover of the safety switch housing and tamper with its internal mechanisms such that the circuit is closed and electrical power supplied to the machinery even when the gate to the enclosure remains open. Alternatively, a worker may obtain a replacement key, or fabricate a makeshift one for him/herself to engage with the safety switch mechanism such that the machinery may be operable even when the gate remains open. Since the purpose of the safety switch is to prevent such access, and to maintain the safety of the workers, tampering with a safety switch or using a replacement key is not desirable.

As stated above, the switch mechanism is housed in a housing and attached to the structure forming the enclosure. It is not uncommon for the switch mechanism to become damaged by repeated use, and in particular damaged by impact from objects such as equipment being carried into and out of the enclosure, or damaged by the gate itself.

It is therefore desired to provide a safety switch to obviate or mitigate at least one of the above-mentioned disadvantages.

SUMMARY OF THE INVENTION

According to a first aspect of the invention there is provided a safety switch assembly, comprising a safety switch and a support structure, the support structure being suitable for forming at least part of an enclosure, the safety switch being arranged to control the supply of electricity to electrically powered apparatus located within the enclosure, wherein the safety switch is located substantially within the support structure.

According to a second aspect of the invention there is provided a safety switch assembly, comprising a safety switch and a support structure, the support structure being suitable for forming at least part of an access point to an enclosure, the safety switch being arranged to control the supply of electricity to electrically powered apparatus located within the enclosure, and wherein the safety switch is located substantially within the support structure.

According to a third aspect of the invention there is provided a safety switch comprising a base plate and electrical contacts, the electrical contacts being mounted on the base plate and being movable between open and closed configurations using an actuator, wherein the base plate is configured so as to be mountable on a support structure such that the electrical contacts are located within the support structure.

By incorporating the safety switch within a supporting structure, many of the above-mentioned disadvantages are obviated or mitigated. For example, by incorporating the safety switch within a supporting structure, it is made more difficult for the switch to be tampered with. In addition, the switch is better protected from impact damage.

According to a fourth aspect of the present invention there is provided a safety switch comprising an actuator receiving portion arranged to receive an actuator of a specific shape. The specific shape is one which permits operation of the switch by the actuator, thereby serving as a first security measure. An additional security measure includes a detector for obtaining an electrical signal representing an identifier provided on the actuator, and a comparator for comparing the obtained identifier with one or more acceptable identifiers. The safety switch is configured to operate only when the first security measure and the additional security measure are satisfied.

By incorporating an additional security measure into the safety switch, access to an enclosure can be more readily controlled. This will help to prevent unauthorised access by users having a correctly shaped key, but not having the necessary corresponding identifier. For example, this additional security measure may comprise a barcode scanner located within the safety switch, and a barcode located on the actuator.

BRIEF DESCRIPTION OF THE DRAWINGS

Embodiments of the present invention will now be described, by way of example only, with reference to the accompanying drawings, in which.

DETAILED DESCRIPTION

Figure 1B:
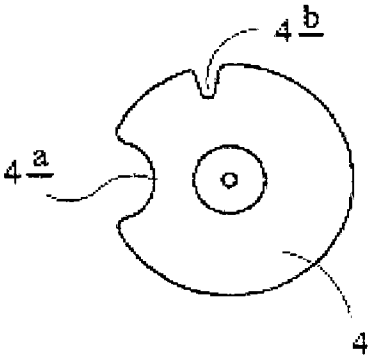
FIGS. 1A-1C are schematic illustrations of a safety switch and actuator according to the invention.
Figure 1C:
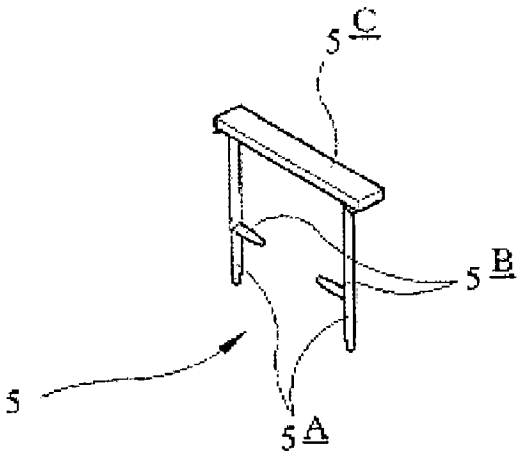
Figure 1A:
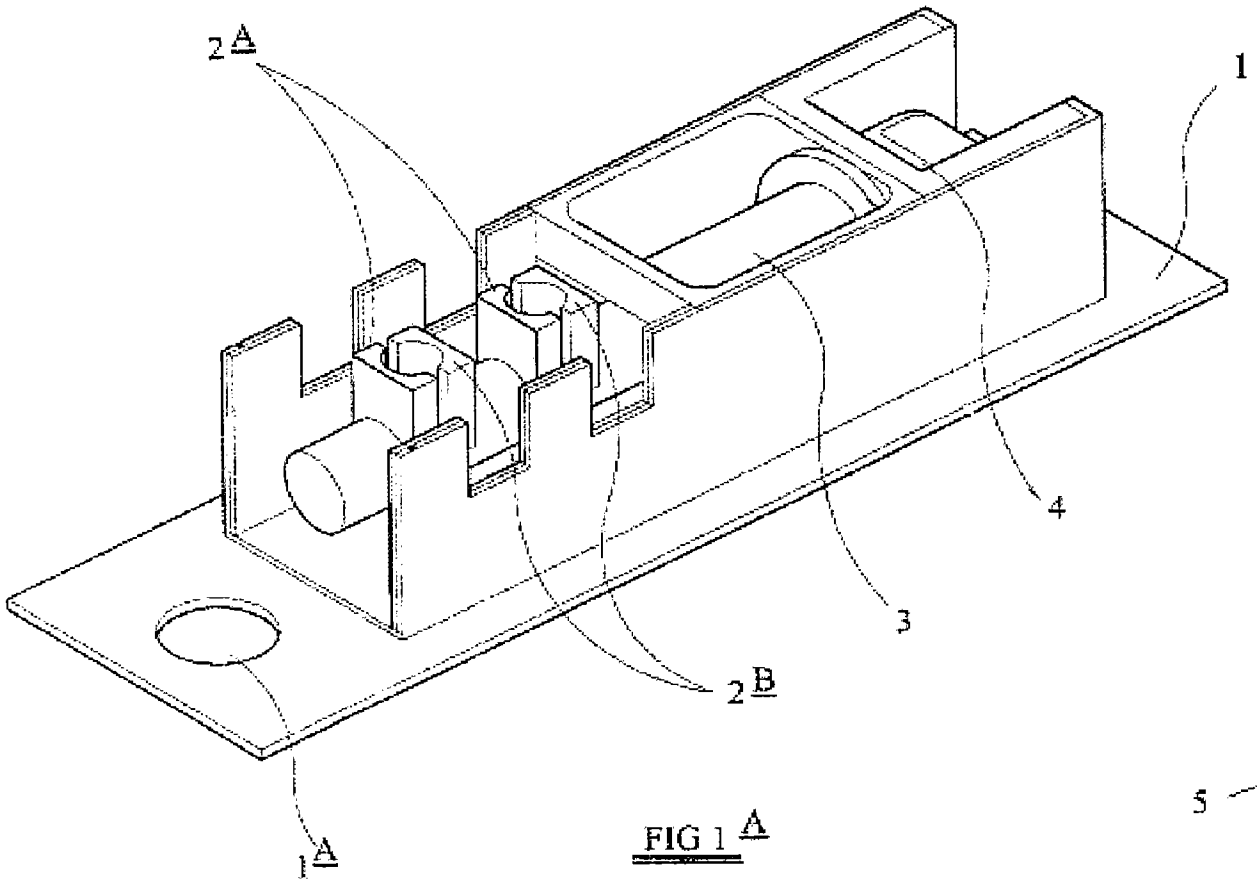

FIG. 1A is a perspective view of a safety switch which embodies the invention. The safety switch comprises a base plate 1, on which is mounted two pairs of contacts 2A, 2B. The base plate 1 is provided with an aperture 1A allowing electrical connection, such as via wires 31 (FIG. 2A), to and from the contacts 2A, 2B. One side 2A of each pair of contacts is fixed in position relative to the base plate 1. The other side 2B of each pair of contacts is movable relative to the base plate 1, and is carried by an axially-movable rod 3. The axially-movable rod 3 is biased by a spring (not shown) which holds the contacts 2A, 2B apart from one another, such that the safety switch serves to act as a break in a circuit. The safety switch may be electrically connected to electrically powered machinery such that no power can be supplied to the electrically powered machinery or apparatus 33 when the safety switch is activated.

The axially-movable rod 3 is movable by a cam surface of a cam arrangement 4. The shape of the cam surface is shown in FIG. 1B. The cam surface is provided with an indentation 4*a*, which is dimensioned such that when it is aligned with an end of the axially-moveable rod 3, the axially moveable rod moves into the indentation under the bias of the spring. The cam surface is provided with a pair of notches 4*b*, which are dimensioned to receive an actuator (only one notch is visible in FIG. 1B).

The actuator 5 is shown in FIG. 1C. The actuator 5 comprises two arms 5A which are provided with fingers 5B. The fingers 5B are dimensioned to be received in the pair of notches 4B provided in the cam surface. The actuator 5 further comprises an extended planar surface 5C, to which the legs 5A are attached. The planar surface 5B serves as a handle for easy engagement and disengagement of the actuator 5 with the pair of notches 4B provided in the cam surface. The planar surface 5C also facilitates attachment of the actuator 5 to a door or gate.

In use, when no actuator 5 is engaged with the cam arrangement 4, the axially-movable rod 3 is pushed by the bias of the spring into the recess 4A in the cam surface. The contacts 2A, 2B are thereby kept open. The safety switch acts as open circuit, and prevents supply of electrical power to any equipment to which it is attached.

When the actuator 5 is engaged with the cam arrangement 4, by insertion of the fingers 5B into the pair of notches 4B, it rotates the cam arrangement 4 in an anti-clockwise direction. This rotates the recess 4A away from the axially-moveable rod 3. The axially-moveable rod 3 is thereby pushed against the bias of the spring, thereby closing the contacts 2A, 2B., The safety switch acts as a closed circuit, and allows electrical power to be supplied to equipment to which it is attached.

Upon removal of the actuator 5, the cam arrangement rotates in a clockwise direction until the recess 4A is aligned with the axially-moveable rod 3. The axially-movable rod 3, moves under the bias of the spring into the recess 4A, thereby opening the electrical contacts 2A, 2B. The supply of electrical power to equipment to which the safety switch is attached is thereby interrupted.

The fingers 5B of the actuator 5 act as identifiers, in the sense that they must be correctly dimensioned in order to engage with the pair of notches 4B of the cam arrangement and thereby actuate the cam. If the fingers 5B of the actuator were not correctly dimensioned, then they would not engage the pair of notches 4B and the cam arrangement would not be rotated by the actuator 5. Thus, an actuator which does not have correctly dimensioned fingers 5B cannot be used to rotate the actuator 5.

Figure 2A:
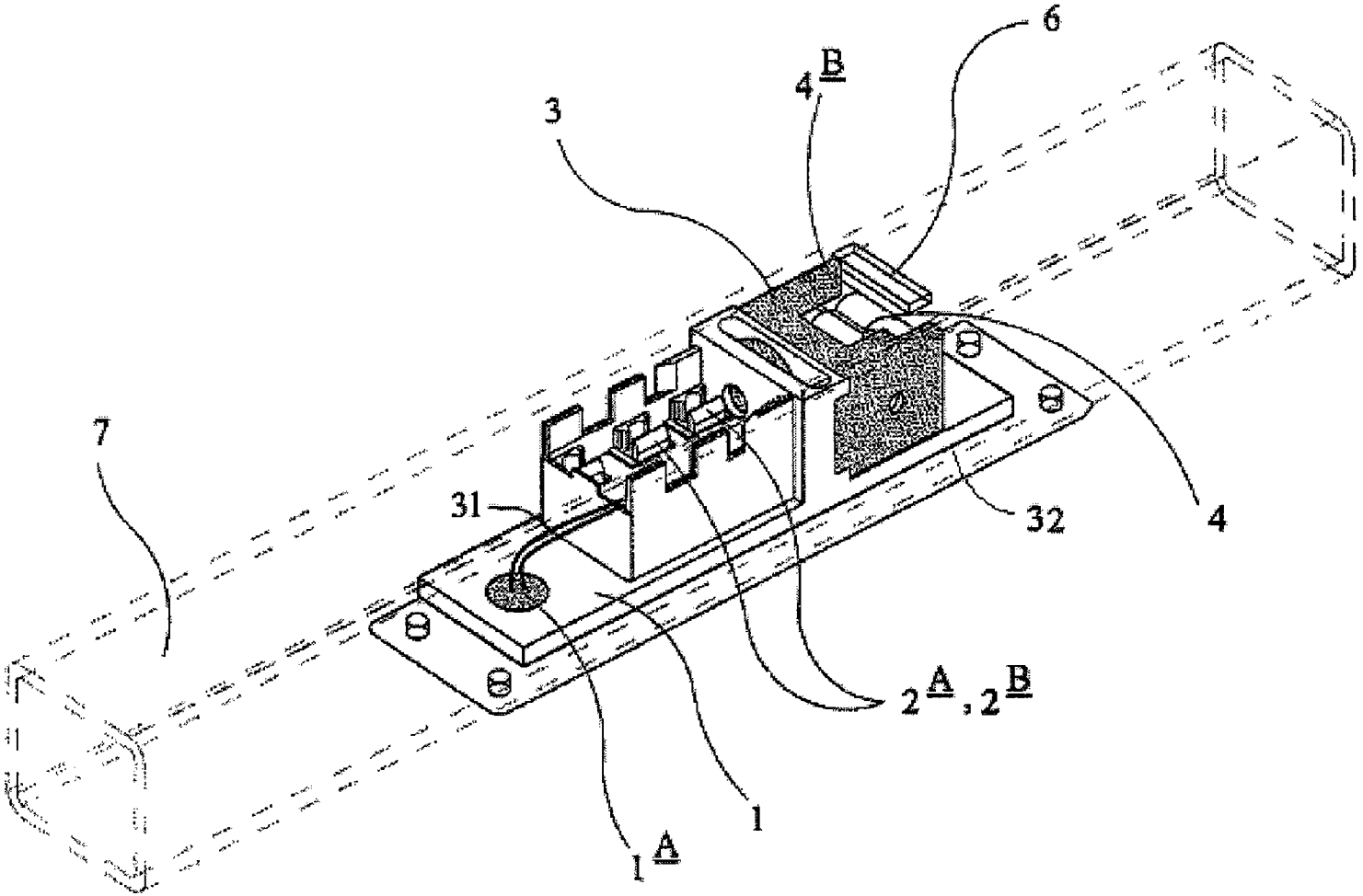
FIGS. 2A-2D schematically illustrates the safety switch of FIGS. 1A-1C located within a supporting structure.

FIG. 2A shows the safety switch of FIG. 1A mounted in an exemplary support structure in the form of a fence post, which may comprise part of an enclosure. The enclosure may contain electrically powered machinery, the supply of electrical power to the machinery being controlled by the safety switch. It will be appreciated that in practice the fence post 7 may not be transparent, and FIG. 2A merely represents the fence post 7 as being transparent to aid the understanding of the invention. A slot 6 is cut in the fence post 7 to allow the actuator (not shown in FIG. 2) to engage with the pair of notches 4B of the cam arrangement. A switch mount opening, an opening, or an aperture 32 is cut into a rear face of the fence post 7 to receive the safety switch. As shown in FIG. 2A, aperture 32 is formed in a side of fence post 7 that is not aligned with the side of fence post 7 having slot 6 formed therein. The safety switch is inserted into the aperture, and then fixed to the fence post 7 using bolts or other attachment means which pass through the base plate 1.

Figure 2B:
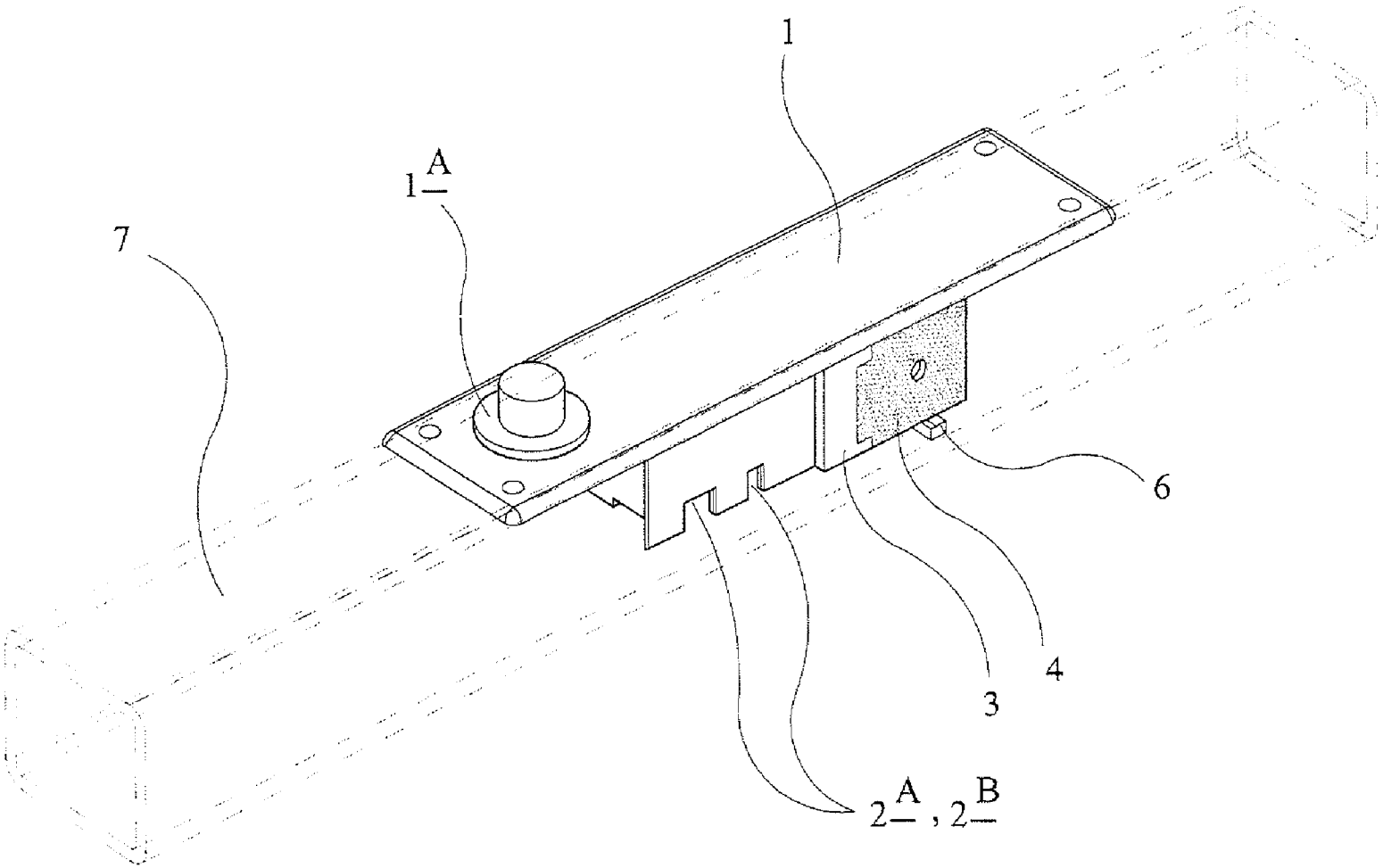
Figure 2C:
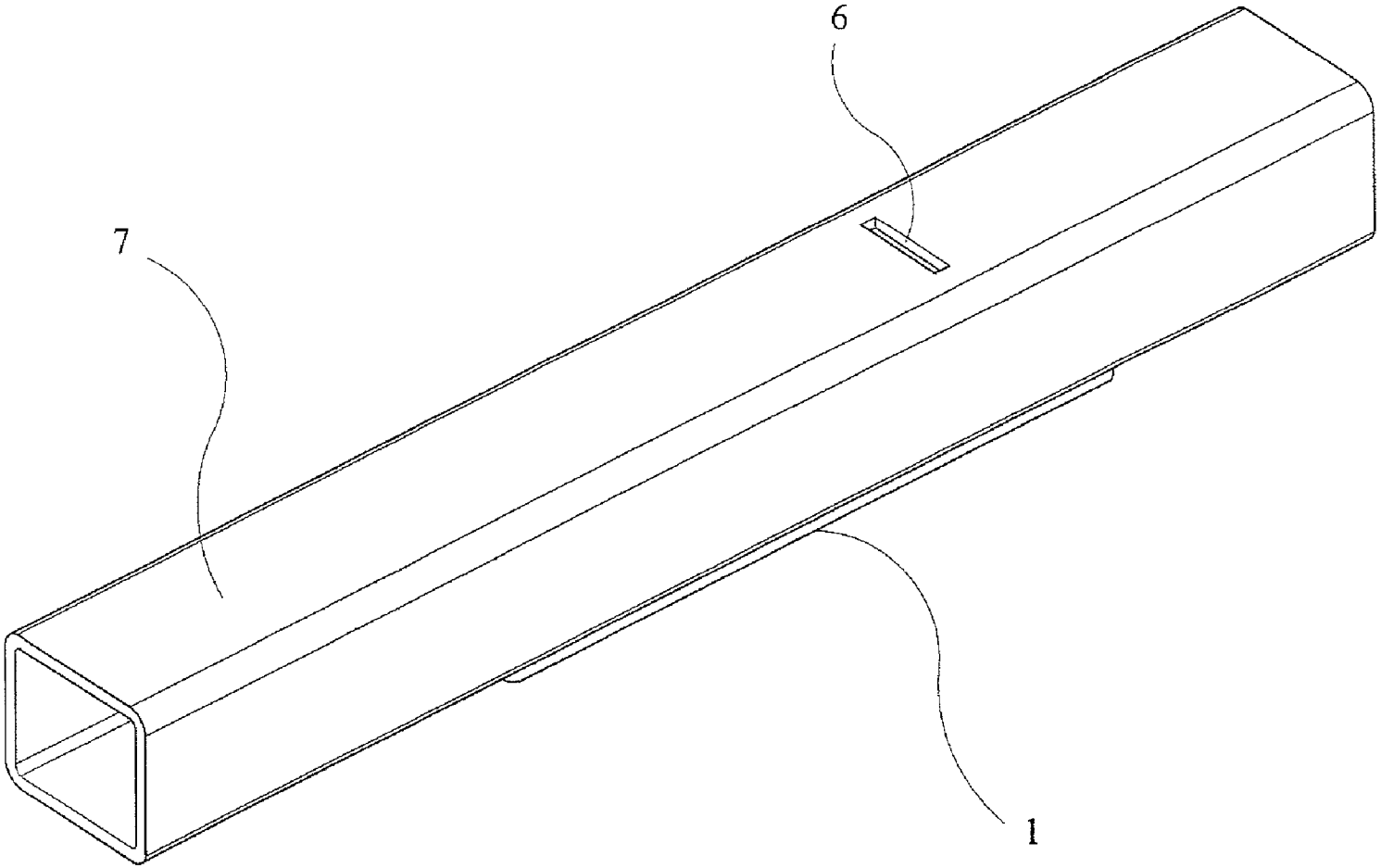
Figure 2D:
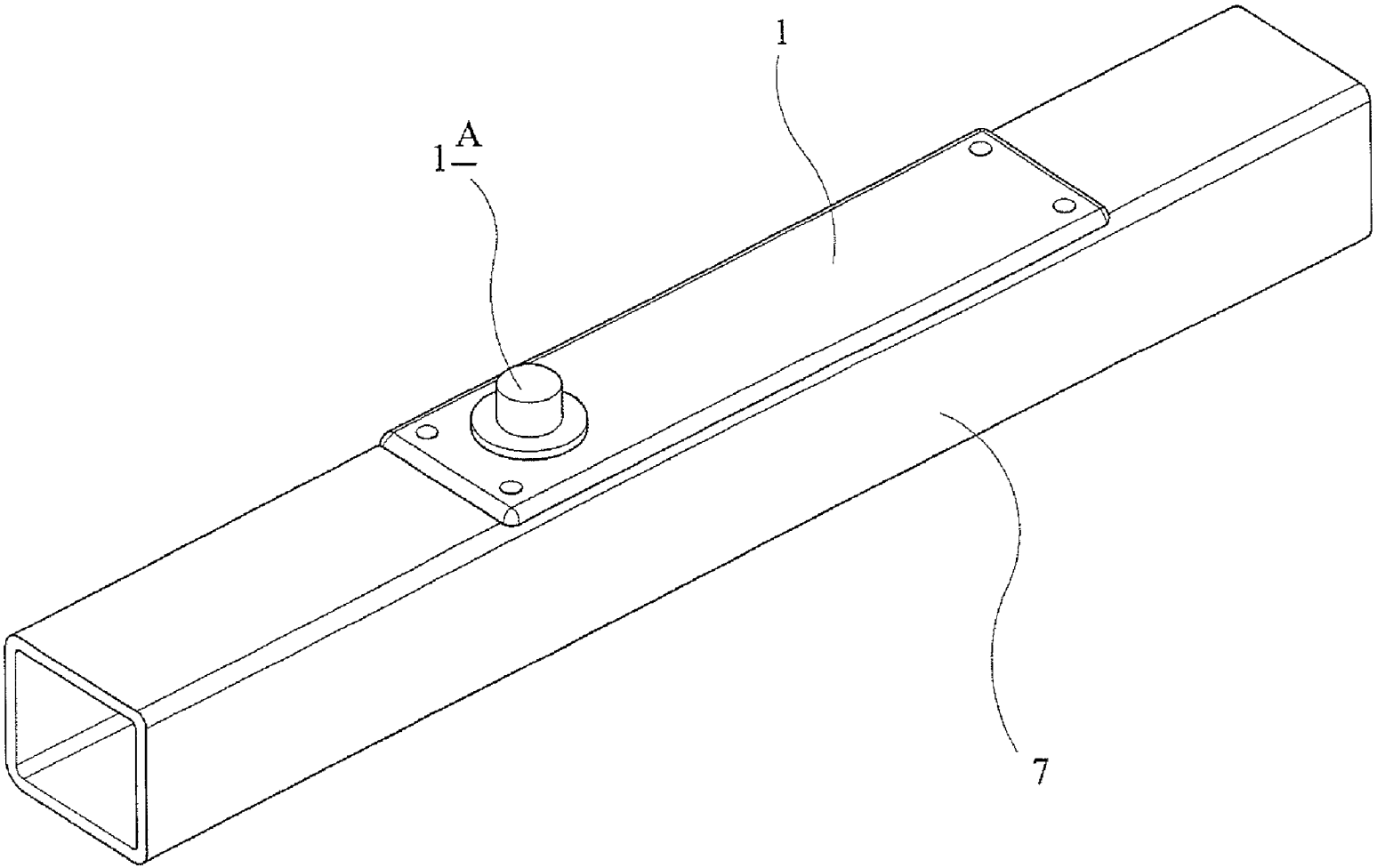

FIG. 2B shows a reverse view of the fence post 7 of FIG. 2A. Once again, the fence post 7 is shown as being transparent as an aid to understanding the invention. FIG. 2C shows the fence post 7 and slot 6A as they would appear if the fence post 7 was not constructed of a transparent material. FIG. 2D illustrates a reverse view of the (non-transparent) fence post 7 of FIG. 2C.

An important difference between the safety switch assembly shown in FIG. 2 and safety switches of the prior art is that the safety switch of FIG. 2 is provided within, and thereby protected by, the fence post 7. Prior art safety switches are conventionally fixed to the exterior of a fence post. They protrude from the post and are therefore susceptible to suffering damage.

Figure 3:
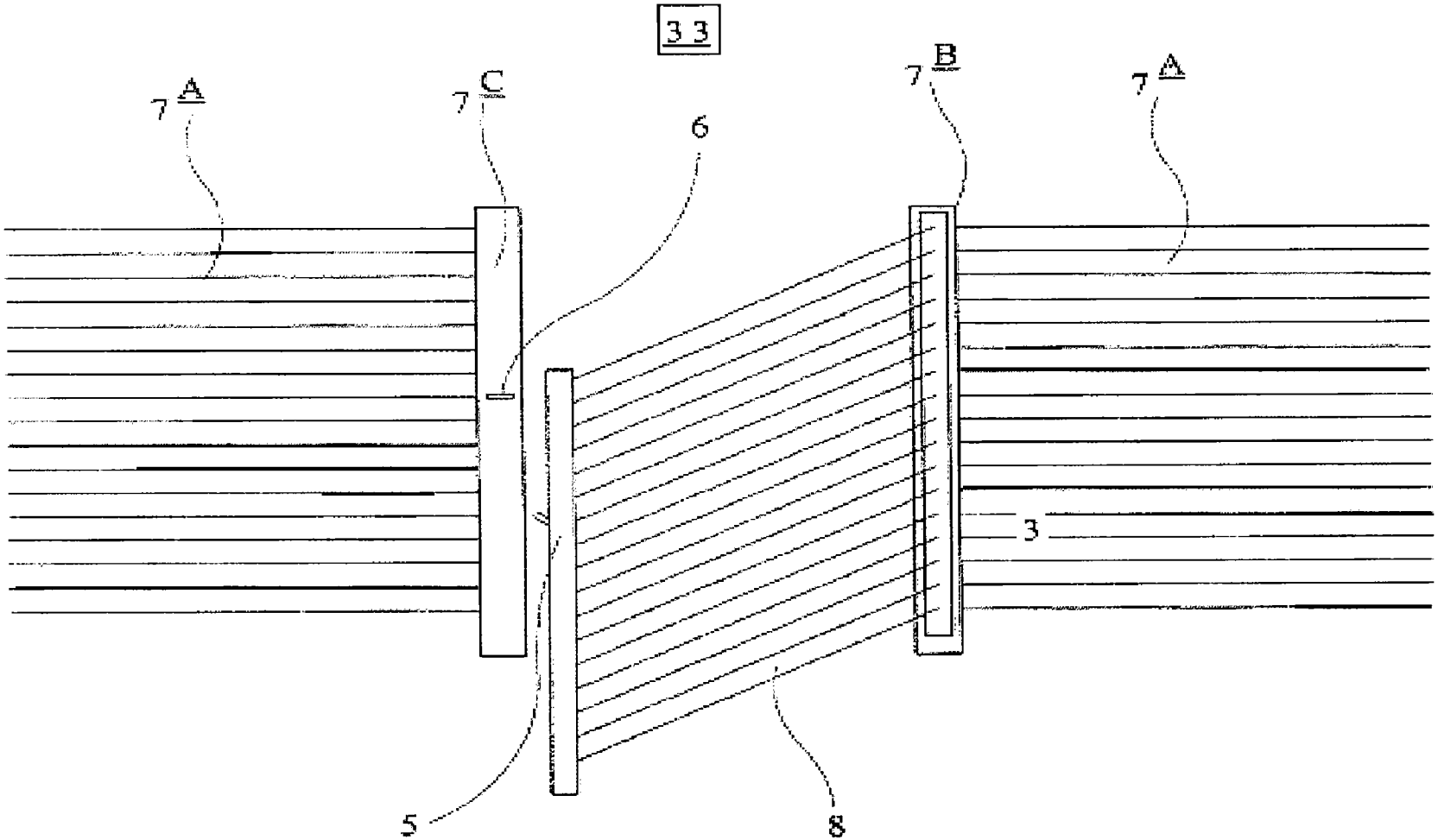
FIG. 3 is a schematic illustration which shows the safety switch of FIG. 2 together with an enclosure.

FIG. 3 illustrates part of an enclosure which may contain dangerous machinery to which access is to be controlled by the safety switch described above. The enclosure is formed from a wire fence 7A and a gate 8. The gate 8 is pivotably attached to a first fence post 7B, and closes to a second fence post 7C. As shown in FIG. 2A, the safety switch is located within a fence post (in this case the second fence post 7C). Access to the safety switch for an actuator 5 is provided by a slot 6 in the second fence post 7C. The actuator 5 is located on the gate 8. The pair of notches (not visible in FIG. 3) of the safety switch and the actuator 5 are positioned such that, upon closure of the gate 8, the actuator 5 passes through the slot 6 and engages with the pair of notches.

An advantage of the embodiment of the invention, which is apparent from FIG. 3, is that it is difficult to tamper with the safety switch. In order to tamper with the safety switch, a user would need to be inside the enclosure, and would also need to remove the safety switch from the second fence post 7C. Prior art safety switches are more readily tampered with, in that all that is needed in order to do so is to remove a front cover of the safety switch. It will also be appreciated that in locating the safety switch in the second fence post 7C (or any suitable supporting structure), it will be possible to connecting the safety switch to an electrical circuit by feeding electrical cabling through the supporting structure. If this configuration is desirable, an aperture 1A in the base plate 1A is no longer required.

The above-mentioned embodiment of the invention overcomes many of the disadvantages identified above. It may still be possible for a person to obtain a copy of the actuator 5 which is attached to the gate 8, and use this to deactivate the safety switch. This would allow electrical power to be supplied to machinery within the enclosure, without the gate 8 to the enclosure being closed.

Figures 4A, 4B:
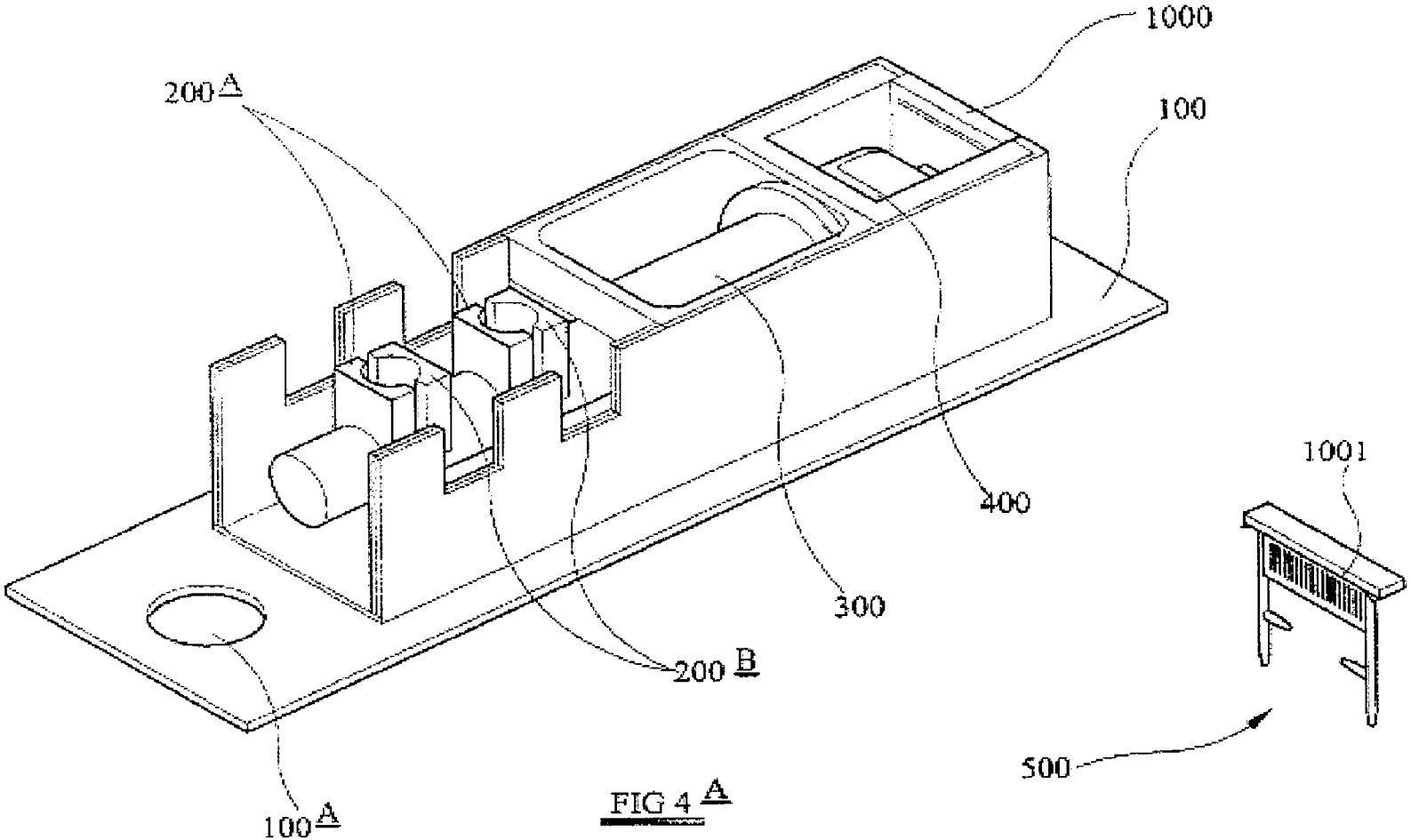
FIGS. 4A-4B are schematic illustrations of a safety switch in accordance with a second embodiment of the invention.

An embodiment of the invention solves this problem by providing the safety switch with an additional security measure. FIG. 4A is a perspective view of a safety switch incorporating such an additional security measure. FIG. 4B illustrates an actuator 500 to be used in conjunction with the safety switch of FIG. 4A. The safety switch of FIG. 4A is substantially the same as the safety switch of FIG. 1A, comprising a base plate 100, onto which are mounted contacts 200A, 200B, an axially-movable rod 300, and a cam arrangement 400. As with the safety switch of FIG.1A, the base plate 100 is provided with an aperture 100A for connection of electrical cables to the contacts 200A, 200B. In terms of the operation of the device, the safety switch of FIG. 4A works in much the same way as described above in relation to the safety switch of FIG. 1A. The difference between the safety switch of FIG. 1A and the safety switch of FIG. 4A is the inclusion of a barcode reader 1000. The barcode reader is located adjacent the cam arrangement 400, and is configured to read a barcode 1001 provided on the actuator 500.

In use, the actuator 500 is made to engage with the pair of notches (not visible) provided in the actuator. As with the safety switch illustrated in FIGS. 1 to 3, if the shape of the actuator 500 is as required to engage the pair of notches, this security measure is satisfied. However, in addition to this physical interaction between the actuator and the pair of notches, the safety switch of FIG. 4A comprises an additional security measure. Only if the barcode 1001 on the actuator 500 is detected and deemed acceptable by the barcode scanner 1000 is the mechanism of the safety switch engaged. This is achieved by the barcode reader 1000 reading the barcode 1001 and comparing it with a list of acceptable barcodes, which may for example be stored in a database or other storage medium (not shown). If the barcode 1001 is acceptable, an additional electrical switch (not shown) is closed. This completes activation of the safety switch, i.e. the contacts 200A, 200B are closed and the additional electrical switch is closed, thereby allowing electrical power to be supplied to machinery connected to the safety switch.

It will be appreciated that a user attempting to circumvent the safety measures provided by the switch may attempt to tamper with the contacts 200A, 200B. It will however be extremely difficult if not impossible for the user to circumvent the barcode scanning security measure using only mechanical means. The additional electrical switch may be remotely located in order to make tampering with the additional electrical switch more difficult.

It will be appreciated that an actuator having the correct barcode will be located on a gate to the enclosure. It may be desirable for a supervisor (for example) to have a spare actuator having an acceptable barcode in case the machinery needs to be operated while the gate is open.

It will be appreciated that unique identifiers other than barcodes, and apparatus for reading or detecting those identifiers, may be used. In general terms, the additional security measure may a detector for obtaining an electrical signal representing an identifier and a comparator for comparing it with one or more acceptable identifiers. The electrical signal may be obtained electronically or optically, the detector being any suitable electronic or optical detector. The comparator may comprise for example a microprocessor configured to compare an electrical signal representing a detected identifier with a database of signals. Alternatively, the comparator may comprise a dedicated electrical circuit.

The actuator may for example incorporate an extremely short-range radio transmitter which may interact with a radio receiver in the safety switch. It will be appreciated that the unique identifier (or a range of unique identifiers) may be stored on a chip (or memory) within the safety switch itself. Alternatively, the actuator may be provided with a passive radio frequency tag, power to which is provided by a radio frequency reader located in the safety switch. Preferably, the additional security measure does not involve any physical contact between the identifier provided on or within the actuator and the reading apparatus. This makes it difficult for a user to circumvent the additional safety measure using only mechanical means (e.g. a screwdriver or an actuator without an identifier). Thus, preferably reading of the identifier is achieved by way of electromagnetic waves or pressure waves.

The above-mentioned embodiments of the invention have been described in relation to a specific safety switch. However, it will be appreciated that the present inventions are equally applicable to any safety switch. For example, the safety switch located in a supporting structure maybe a non-contact switch, i.e. a switch that does not require a physical actuator or key to enter the switch mechanism to activate it. For example, the non-contact switch may be a magnetic switch. Alternatively, the non-contact switch may be a light curtain (i.e. a switch that is activated when a beam of light is broken). In a non-contact switch, the 'actuator' may be a magnetic field or a beam of light (or a break in that beam) that in some way engages or interacts with the safety switch. The safety switch may be provided with locking means for locking the gate 8 to the second fence post 7C.

While the above-mentioned embodiments describe a safety switch located within a fence post, it will be appreciated that the safety switch may be located in any suitable supporting structure. For example, the supporting structure may be a door frame, a gate post, a fence post or a window frame. The safety switch may be located in a supporting structure of an enclosure or an access point thereto. For example, the safety switch may be located in a door, a gate or a window, in which case, the actuator may be located on a door frame, a gate post, a fence post or a window frame.

It will be appreciated that an enclosure may be anything which encloses electrically powered equipment, the power supply to which is controlled by a safety switch. An enclosure may be, for example, a room, a cage or a fully or partially fenced off area.

It will be appreciated that the above embodiments of the invention have been described by way of example only, and various modifications may be made to these embodiments without retracting from the invention, which is defined by the claims, which follow.

What is claimed is:

1. A safety switch assembly that is partially enclosed by a support structure that forms part of an enclosure positioned about an electrically powered apparatus and that prevents exposure of users to the electrically powered apparatus, the safety switch assembly comprising:

a base plate having a conductor passage;

a pair of electrical contacts that are supported by the base plate and arranged to control a supply of electricity to the electrically powered apparatus located within the enclosure;

a cam arrangement;

an actuator that cooperates with the cam arrangement to alter a condition of the electrical contacts;

a slot formed in a first side of the support structure to allow the actuator to engage the cam arrangement from a first direction; and an opening formed in a side of the support structure that is not aligned with the first direction so that the support structure encloses the electrical contacts from atmosphere and in a manner that aligns the cam arrangement with the slot; and wherein the base plate cooperates with the opening to enclose the safety switch assembly in the support structure so that the safety switch assembly can only be removed from the support structure from a location inside the enclosure and the conductor passage allows connection of the electrical contacts to the electrically powered apparatus.

2. The safety switch assembly of claim 1, wherein the support structure is one of a group comprising: a door frame, a gate post, a fence post and a window frame.

3. The safety switch assembly of claim 1 wherein the electrical contacts are closed when an actuator engages with the cam by way of the slot such that the safety switch assembly is able to conduct electricity.

4. The safety switch of claim 3 wherein the actuator further comprises an additional security measure that is required to configure the safety switch assembly such that the electrical contacts are able to conduct electricity.

5. The safety switch assembly of claim 1 wherein the electrical contacts are forced open when an actuator is disengaged from the safety switch assembly such that the safety switch assembly is unable to conduct electricity.

6. A safety switch assembly that is configured to cooperate with a support structure of an enclosure that is positioned about an electrically powered apparatus, the enclosure configured to prevent exposure of users to the electrically powered apparatus and the safety switch assembly configured to allow operation of the safety switch from outside the enclosure and access to the safety switch only from inside the enclosure, the safety switch assembly comprising:

a base plate;

electrical contacts that are mounted to the base plate and are movable between open and closed configurations;

a wiring opening formed in the base plate to accommodate wiring being connected to the electrical contacts;

an actuator that is removably engageable with the safety switch from a position outside the enclosure and in a first direction so as to move the electrical contacts between the open and closed configurations;

a switch mounting opening formed in a side of the support structure that is not aligned with the first direction, the switch mount opening configured to allow the electrical contacts to pass into the support structure to align a cam with an actuator opening so that the support structure provides a housing for the electrical contacts; and wherein the switch mounting opening is smaller than the base plate so that the base plate covers the switch mounting housing and can only be removed from the support structure in a direction within the enclosure.

7. The safety switch of claim 6 wherein the support structure also provides a housing for a cam and rod that are provided on the base plate of the safety switch assembly.

8. The safety switch of claim 6 wherein the actuator is configured to cooperate with the safety switch assembly to permit operation of the safety switch assembly, the actuator further comprising an additional security measure that is required to configure the safety switch assembly such that the safety switch assembly is able to conduct electricity.

* * * * *